US007513792B2

(12) United States Patent
Kumakura

(10) Patent No.: US 7,513,792 B2
(45) Date of Patent: Apr. 7, 2009

(54) CHAINED-TERMINALS BODY, METHOD OF MANUFACTURING THE SAME, AND CRIMPER FOR CRIMPING THE SAME

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 35 days.

(21) Appl. No.: 11/544,740

(22) Filed: Oct. 10, 2006

(65) Prior Publication Data

US 2007/0117476 A1 May 24, 2007

(30) Foreign Application Priority Data

Nov. 18, 2005 (JP) ..... 2005-333965

(51) Int. Cl.
*H01R 4/24* (2006.01)

(52) U.S. Cl. ..... 439/422; 439/885; 439/878

(58) Field of Classification Search ..... 439/421–423, 439/877, 878, 885; 29/874, 884
See application file for complete search history.

(56) References Cited

U.S. PATENT DOCUMENTS 4,784,623 A * 11/1988 Beck, Jr. ..... 439/872
5,078,617 A * 1/1992 Gutierrez et al. ..... 439/422
7,125,278 B2 * 10/2006 Maitani et al. ..... 439/422

FOREIGN PATENT DOCUMENTS

JP 7-288143 10/1995

* cited by examiner

*Primary Examiner*—Tho D Ta
(74) *Attorney, Agent, or Firm*—Kratz, Quintos & Hanson, LLP.

(57) ABSTRACT

Providing a chained-terminals body, which can be crimped to a flat circuit body in one process even if a terminal pitch thereof is small, the chained-terminals body is formed by piling a pair of chained-terminals sub-bodies. Each of the pair of chained-terminals sub-bodies includes first terminals or second terminals to be arranged in parallel to each other at even intervals. First cover clamp pieces of the first terminals and second cover clamp pieces of the second terminals are sifted alternately to each other in a direction along length of the terminals.

4 Claims, 5 Drawing Sheets

F.I G. 1

CHAINED-TERMINALS BODY, METHOD OF MANUFACTURING THE SAME, AND CRIMPER FOR CRIMPING THE SAME

The priority application Number Japan Patent Application 2005-333965 upon which this patent application is based is hereby incorporated by reference.

BACKGROUND OF THE INVENTION

1. Field of the Invention

This invention relates to a chained-terminals body, in which terminals are arranged in parallel to each other at even intervals, to be crimped in one process to electric wires, such as a flat circuit body, a crimper for crimping the terminals of the chained-terminals body to the electric wires, and a method of manufacturing the chained-terminals body.

2. Description of the Related Art

Various electronic devices are mounted in a car as a vehicle. Wiring harnesses are wired in the car for transmitting electric power and control signals to the electronic devices. Each wiring harness includes a plurality of electric wires and a plurality of connectors. The electric wire is a conductive core wire (call conductor hereafter) covered with a cover of an insulator, that is a covered wire.

A set of the connectors includes a pair of insulating connector housings connected to each other and electrically conductive terminals received in the connector housings. The terminal has a wire connecting portion, at one end thereof, joined to an end of the electric wire to connect electrically to the conductor and an electric contact portion, at the other end thereof, to touch a mating terminal. By connecting the connector housings to each other, the wiring harness transmits the control signals to the electronic devices.

Number of wires of the wiring harness is increasing in proportion with increase of the electronic devices mounted in the car. For wiring with high density and a small room, a method of crimping the plurality of terminals to a flat circuit body, in which a plurality of conductor arranged in parallel with a gap to each other is covered with a cover, is proposed; refer the Japan Published Patent Application No. H07-288143.

SUMMARY OF THE INVENTION

Objects to be Solved

A pitch of conductors of the flat circuit body is narrowing for high density packaging of the wiring harness as mentioned above. For crimping the terminals to such conductors, a chained-terminals body with a narrower terminal pitch is required.

The terminal to be crimped to the flat circuit body has a bottom wall to place the electric wire thereon and a set of cover clamp pieces extending perpendicularly from the bottom wall for clamping the cover of the electric wire. When crimping the terminals to the flat circuit body, each terminal of the chained-terminals body, in which the terminals are arranged in parallel to each other at intervals, is crimped to each conductor of the flat circuit body.

The chained terminal body is formed by punching and forming one sheet of a sheet metal. A distance between adjacent terminal, that is terminal pitch, cannot be narrowed under a limitation. It is difficult to manufacture a chained-terminals body, which can be crimped in one process to the flat circuit body with a narrower terminal pitch.

Even if a chained-terminals body with a narrow terminal pitch corresponding to the flat circuit body with the narrower terminal pitch is manufactured, the following other problem appears as shown in FIG. 6, which shows dimensional relation between a chained-terminals body with a narrower pitch by prior art and a crimper corresponding to the chained-terminals body by prior art.

In FIG. 6, there are a chained-terminals body 100, in which terminals 101 are arranged in parallel to each other at intervals, and a crimper 102. As shown in FIG. 6, each terminal 101 of the chained-terminals body 100 is positioned in each groove 104 of the crimper 102. When the crimper 102 moves down toward the terminals 101, each clamp piece 103 extending perpendicularly from both sides of a bottom wall 105 of the terminal 101 slides on an inner surface of the groove 104. Thereafter, front ends of the clamp pieces 103 are deformed to approach the bottom wall 105 so as to clamp a flat circuit body (not shown) in one process.

When the terminal pitch of the chained-terminals body 100 becomes narrower as shown in FIG. 6, the interval between the clamp pieces 103 of the adjacent terminals 101 becomes narrower also. In the crimper 102, a thickness of a partitioning wall 106 provided between the adjacent grooves 104 is limited about mechanical strength thereof to be thinner. When the interval between the clamp pieces 103 of the adjacent terminals 101 is under a limited thickness of the partitioning wall 106, it is impossible to clamp the terminal 101 by the crimper 102. In other words, when the interval between the clamp pieces 103 of the adjacent terminals 101 becomes under a limited distance, it is impossible to manufacture the crimper 102, which can clamp the terminals 101 of the chained-terminals body 100 in one process.

To overcome the above problems, objects of the present invention are to provide a chained-terminals body with a narrow terminal pitch and a crimper allowable to clamp the chained-terminals body to a flat circuit body, and to provide a method of manufacturing the chained-terminals body with a narrow terminal pitch corresponding to the flat circuit body with a narrow conductor pitches.

How to Attain the Object of the Present Invention

In order to attain the object of the present invention, a chained-terminals body includes terminals respectively having a bottom wall to place an electric wire thereon and a set of cover clamping pieces extending perpendicularly from the bottom wall; and a connecting band continued to the terminals to be arranged in parallel to each other at even intervals, and sets of the cover clamping pieces of the adjacent terminals are arranged alternately to each other in a direction of lengthwise of the terminal.

The chained-terminals body is further characterized in the chained-terminals body as mentioned above in that the electric wires are formed by a flat circuit body, in which a plurality of conductors arranged in parallel to be spaced with each other is covered with a cover, and a conductor pitch of the plurality of conductors of the flat circuit body corresponds to a terminal pitch of the chained-terminals body.

A chained-terminals body includes a first chained-terminals sub-body including first terminals respectively having a first bottom wall to place an electric wire thereon and a set of first cover clamping pieces extending perpendicularly at a first position from the first bottom wall, and a first connecting band continued to the first terminals to be arranged in parallel to each other at even intervals; and a second chained-terminals sub-body including second terminals respectively having a second bottom wall to place an electric wire thereon and a set of second cover clamping pieces extending perpendicularly at a second position other than the first position from the second bottom wall, and a second connecting band continued to the second terminals to be arranged in parallel to each other at the same even intervals as that of the first chained-terminals sub-body, and the first chained-terminals sub-body and the second chained-terminals sub-body are assembled by piling on each other so as to position each of the first terminals between the second terminals adjacent to each other to arrange all terminals at half of even intervals, and arrange sets of first/second cover clamping pieces of the adjacent terminals alternately to each other in a direction of lengthwise of the first/second terminal.

A crimper is for crimping each of a plurality of terminals arranged in parallel to each other at even intervals to each electric wire in one process, the plurality of terminals respectively having a bottom wall to place the electric wire thereon and a set of cover clamping pieces, which clamp a cover of the electric wire, extending perpendicularly from the bottom wall, and includes a plurality of grooves for clamping the cover clamping pieces, and the grooves adjacent to each other in a direction of widthwise of the terminal are arranged alternately in a direction of lengthwise of the terminal.

The crimper is further characterized in the crimper as mentioned above in that the grooves arranged at one interval are arranged on a same line along the direction of widthwise of the terminal.

A method of manufacturing a chained-terminals body having chained-terminals arranged in parallel at even intervals to each other includes the steps of punching and forming a first chained-terminals sub-body, which includes first terminals respectively having a first bottom wall to place an electric wire thereon and a set of first cover clamping pieces extending perpendicularly at a first position from the first bottom wall; and a first connecting band continued to the first terminals to be arranged in parallel to each other at even intervals; punching and forming a second chained-terminals sub-body, which includes second terminals respectively having a second bottom wall to place an electric wire thereon and a set of second cover clamping pieces extending perpendicularly at a second position other than the first position from the second bottom wall; and a second connecting band continued to the second terminals to be arranged in parallel to each other at the same even intervals as that of the first chained-terminals sub-body; and assembling a chained-terminals body by piling the first chained-terminals sub-body and the second chained-terminals sub-body on each other so as to position each of the first terminals between the second terminals adjacent to each other to arrange all terminals at half of even intervals, and arrange sets of first/second cover clamping pieces of the adjacent terminals alternately to each other in a direction of lengthwise of the first/second terminal.

Effect of the Invention

According to the invention, since sets of clamp pieces of the adjacent terminals are not arranged on the same line, an interval between the set of clamp pieces and adjacent terminal can become larger than a usual interval when the terminal pitch of the chained-terminals body is shortened. Thereby, a thickness of the crimper for clamping the set of clamp pieces does not become thinner, and strength of the crimper can be maintained. The crimper corresponding to the chained-terminals body with a narrower terminal pitch can be made. The chained-terminals body with a narrow terminal pitch, which can be clamped to electric wires in one process, can be provided. Since the interval between the set of clamp pieces and adjacent terminal can become larger, design flexibility of a shape of the clamp piece is improved to increase reliability of connection and working property.

According to the invention, since the conductor pitch of the flat circuit body corresponds to the terminal pitch of the chained terminal body, the terminals can be clamped to the flat circuit body easily, thereby, productivity can be improved.

According to the invention, by piling a plurality of chained-terminals sub-bodies on each other, the chained-terminals body with a narrow terminal pitch can be provided.

According to the invention, since the adjacent grooves of the crimper are not arranged on the same line, a partitioning wall between the grooves is not relatively narrowed by reducing the pitch of the grooves. Thereby, the crimper securing strength can be manufactured. Therefore, the crimper, which can crimp the terminals of the chained-terminals body with a narrow terminal pitch, is provided.

According to the invention, since the grooves arranged at one interval are arranged on the same line along the direction of widthwise of the terminal, width of the crimper along lengthwise of the terminal can be minimized.

According to the invention, since the chained-terminals body with a narrow terminal pitch can be formed by piling the plurality of chained-terminals sub-bodies, the chained-terminals body with a narrow terminal pitch corresponding to the flat circuit body with a narrow conductor pitch can be provided.

The above and other objects and features of this invention will become more apparent from the following description taken in conjunction with the accompanying drawings.

DESCRIPTION OF THE PREFERRED EMBODIMENT

Figure 1:
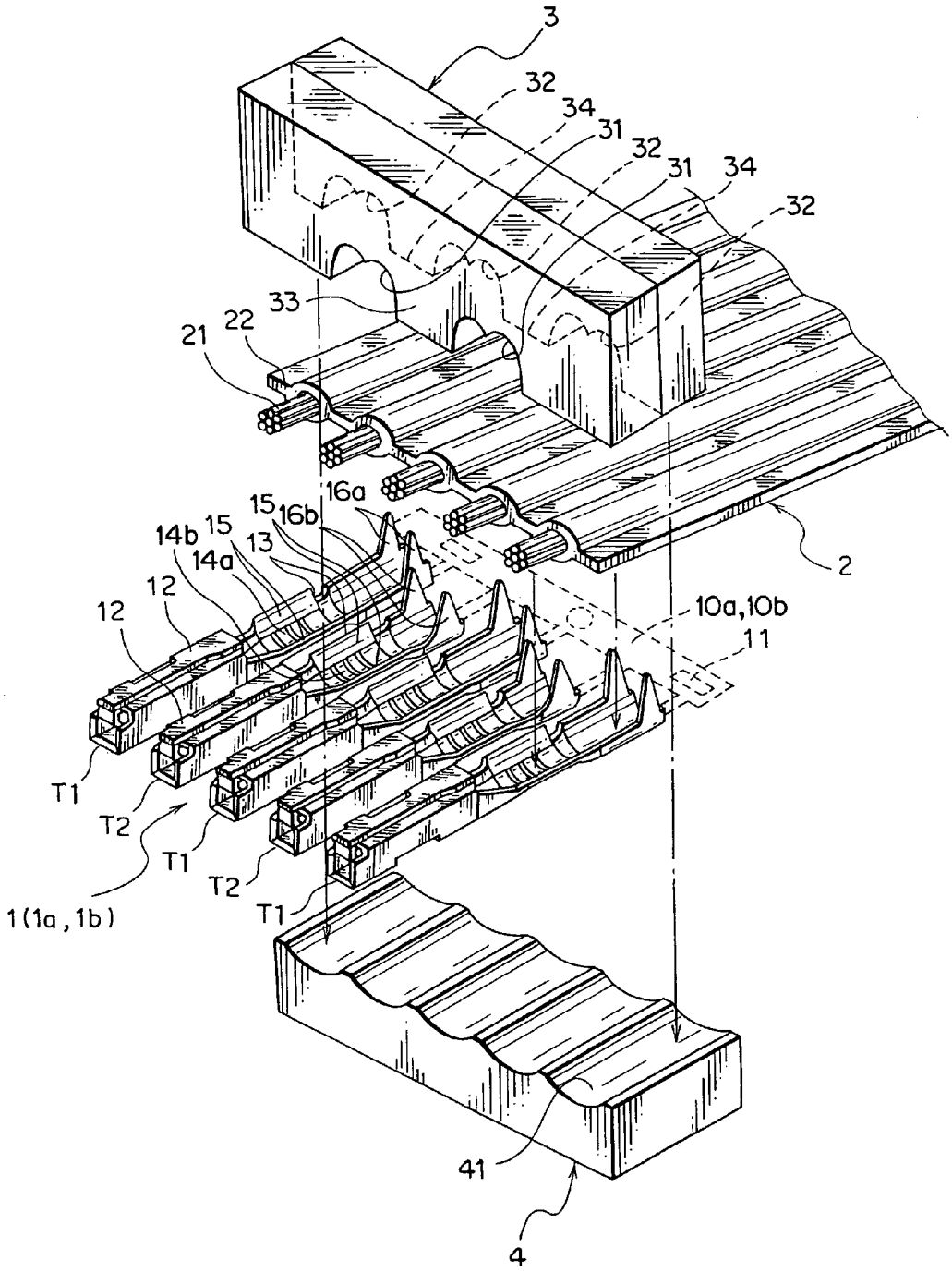
FIG. 1 is a perspective view of a chained-terminals body and a crimper of an embodiment according to the present invention.
Figure 2:
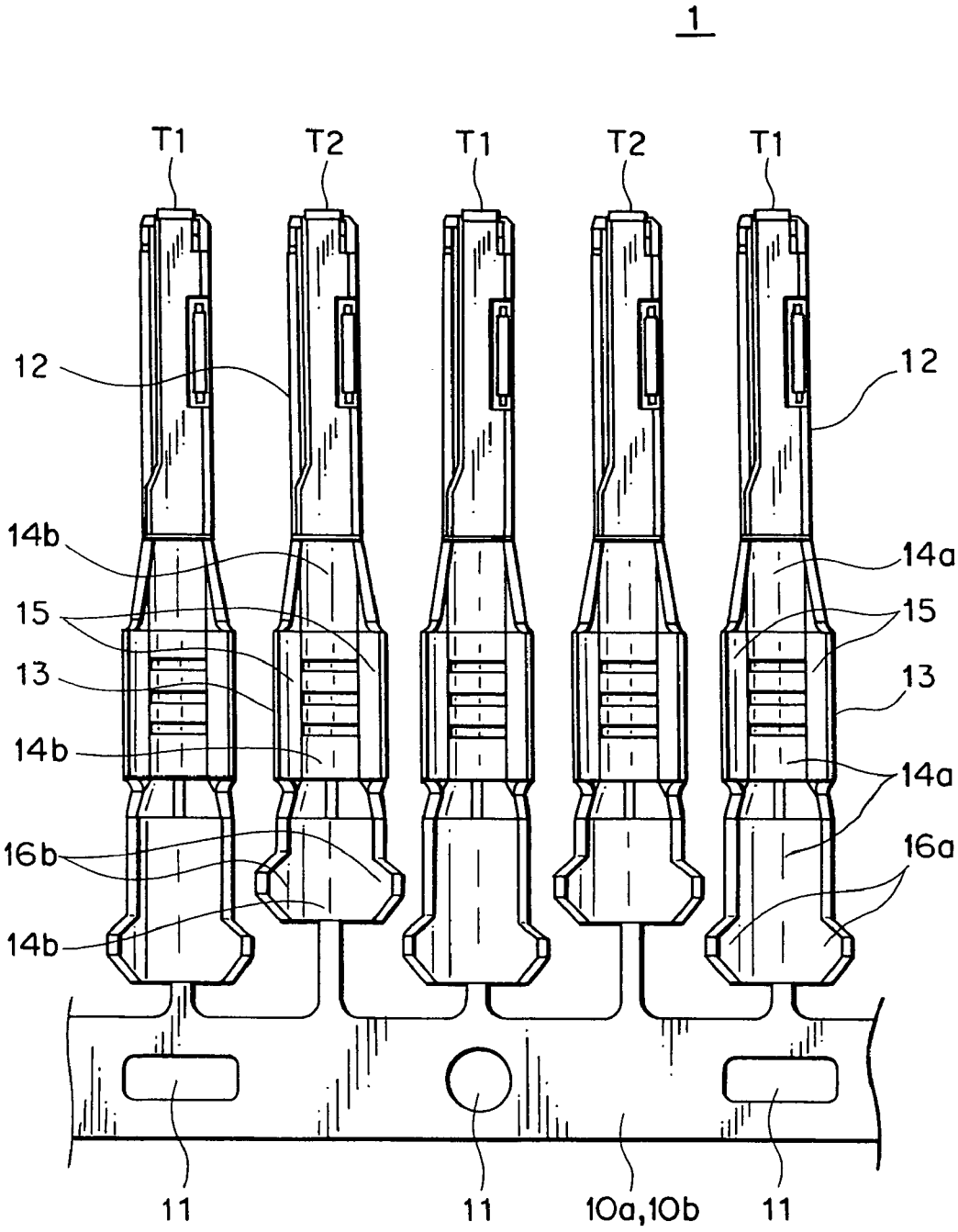
FIG. 2 is a plan view of the chained-terminals body shown in FIG. 1.
Figure 3:
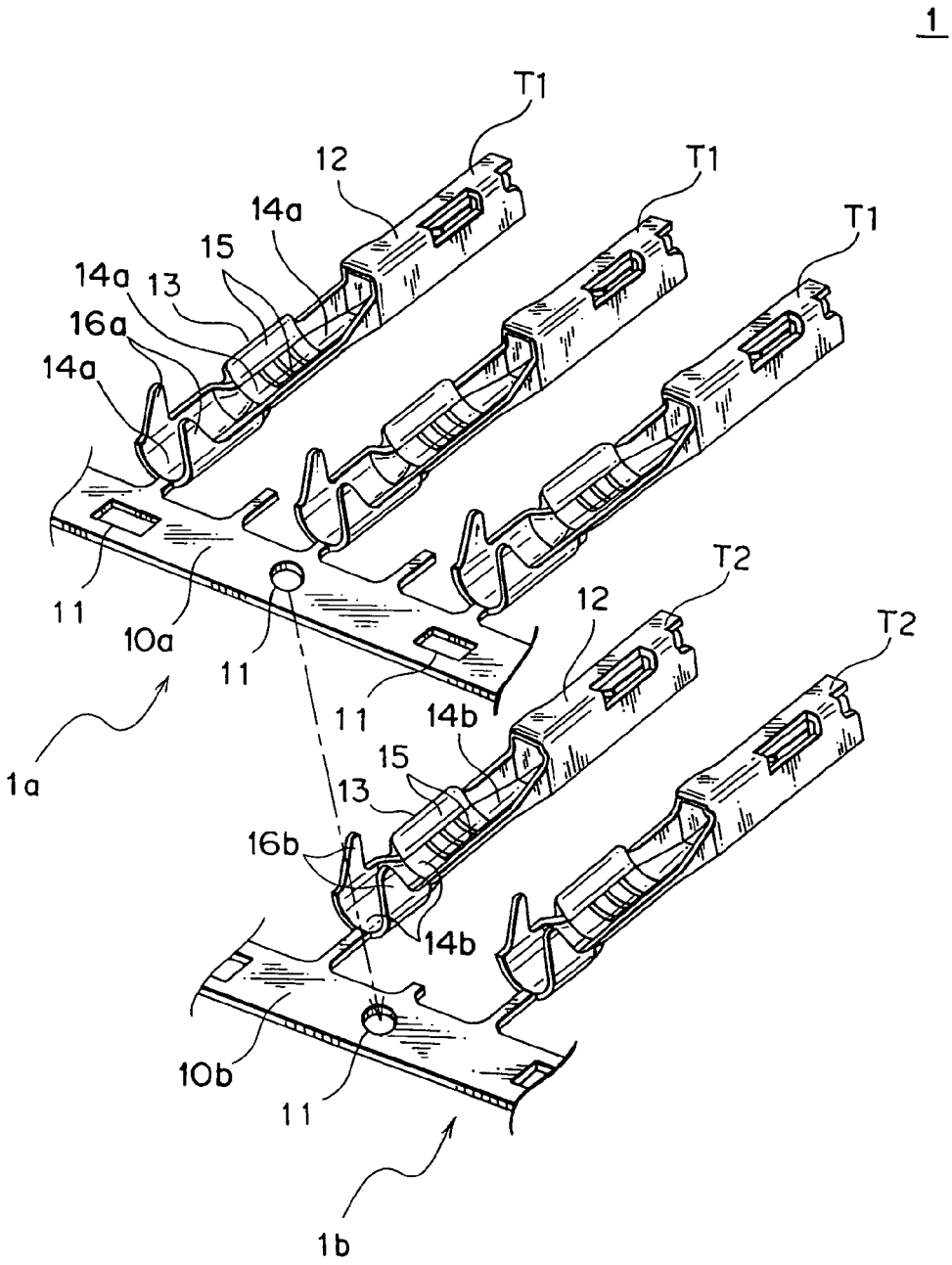
FIG. 3 is a perspective view of chained-terminals sub-bodies to be assembled to the chained-terminals body shown in FIG. 1.
Figure 4:
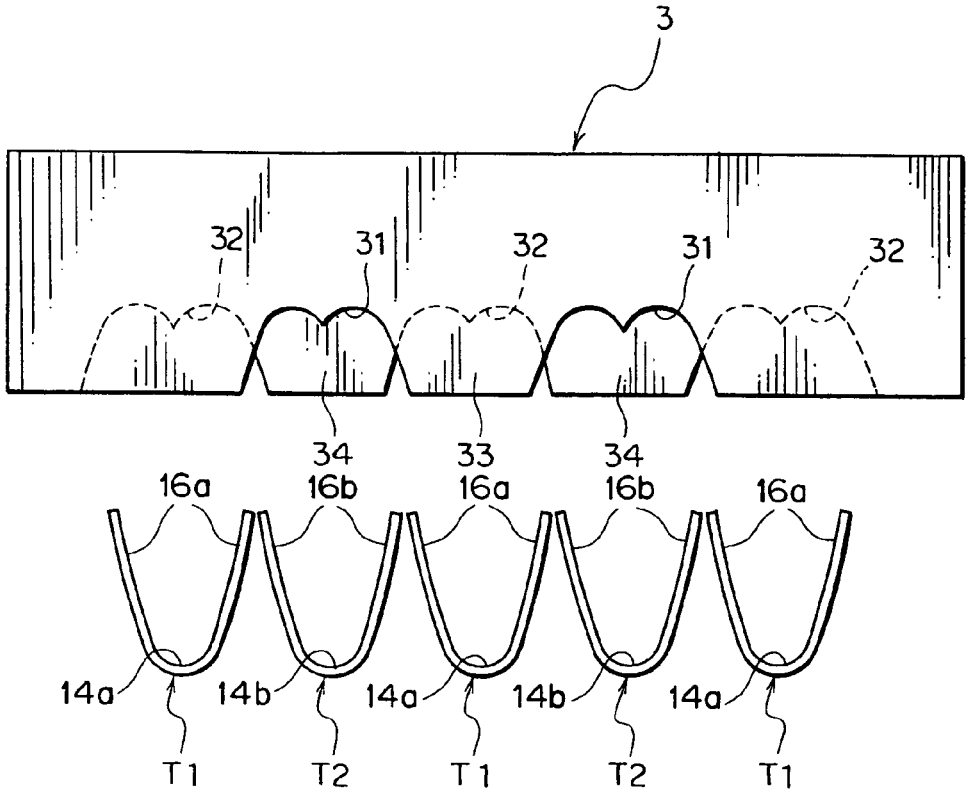
FIG. 4 is a front view of clamp pieces of the chained-terminals body and the crimper shown in FIG. 1 for showing a positional relation therebetween.
Figure 5:
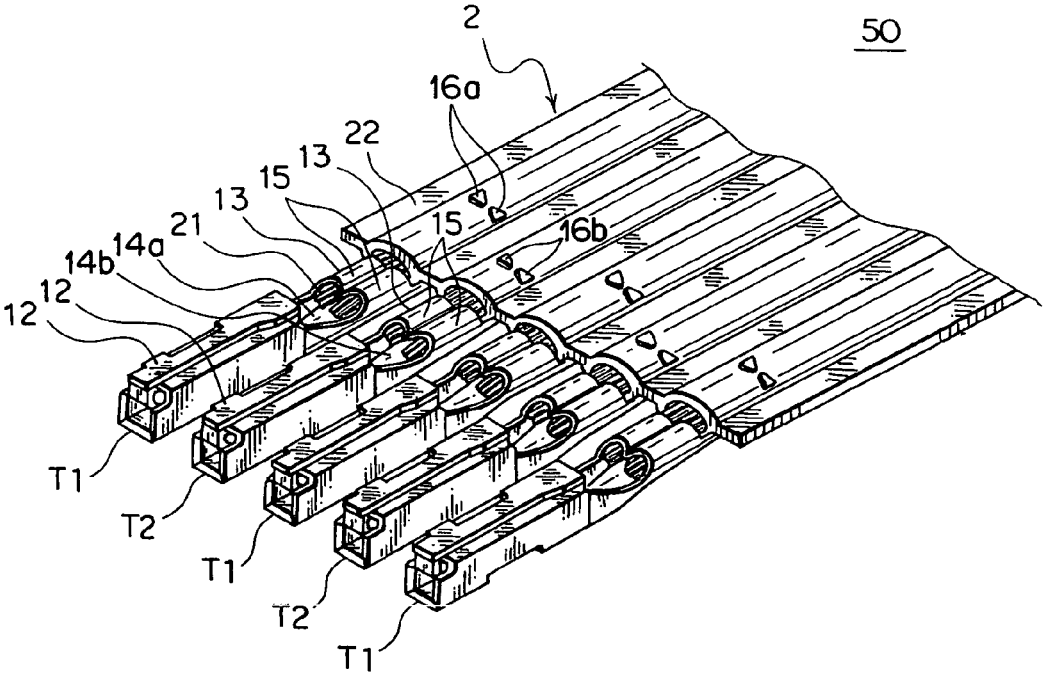
FIG. 5 is a perspective view of assembly of crimping the terminals of the chained-terminals body to a flat circuit body shown in FIG. 1.
Figure 6:
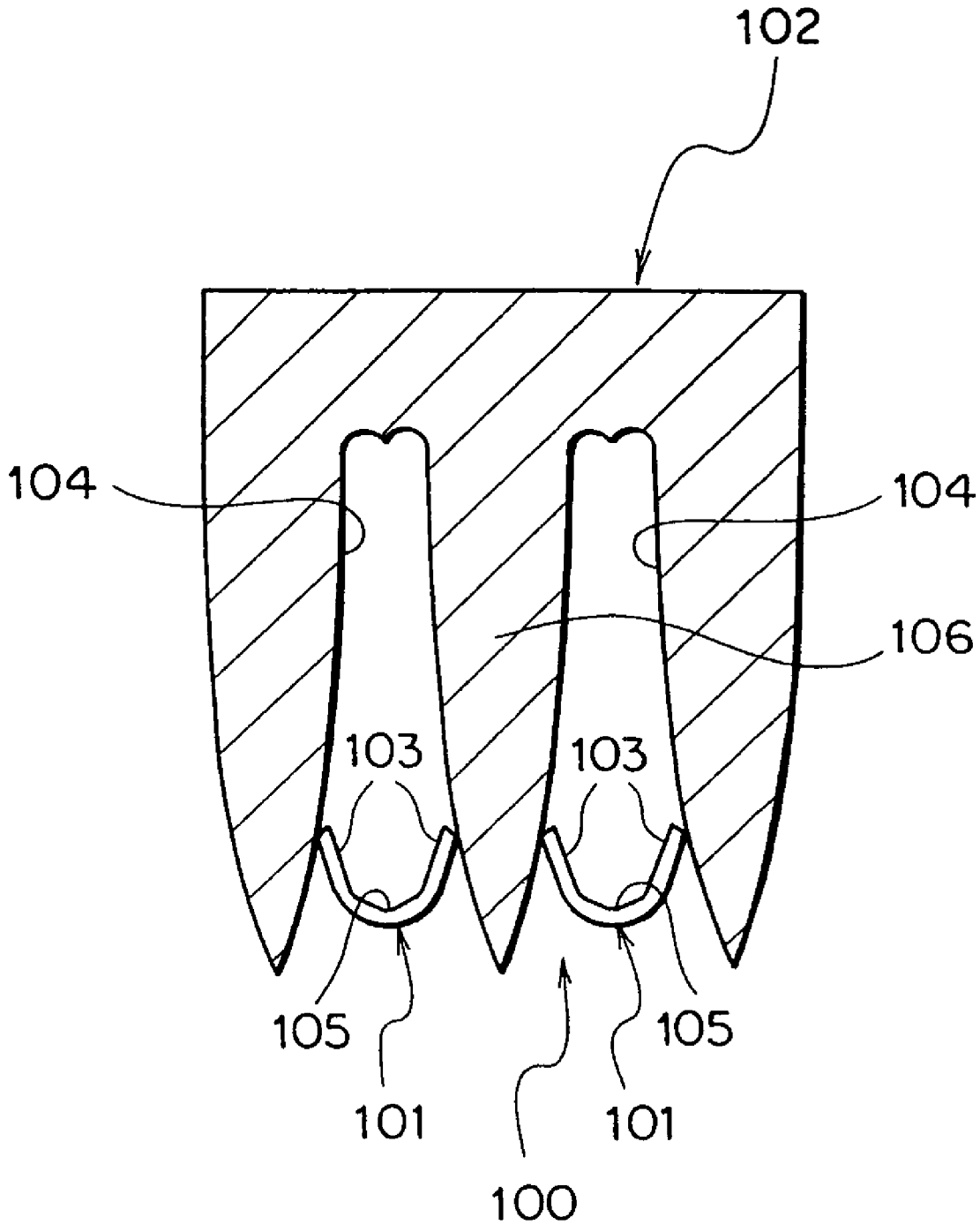
PRIOR ART FIG. 6
FIG. 6 is a partial front view of a chained-terminals body by prior art and a crimper by prior art for showing a relation of a terminal pitch and a partitioning wall of the crimper.

A chained-terminals body 1 of an embodiment according to the present invention will be described with reference to FIGS. 1-5. FIG. 1 is a perspective view of a chained-terminals body and a crimper of each embodiment according to the present invention. FIG. 2 is a plan view of the chained-terminals body shown in FIG. 1. FIG. 3 is a perspective view of chained-terminals sub-bodies to be assembled to the chained-terminals body. FIG. 4 is a front view of clamp pieces of the chained-terminals body and the crimper shown in FIG. 1 for showing a positional relation therebetween. FIG. 5 is a perspective view of assembly of crimping the terminals of the chained-terminals body to a flat circuit body shown in FIG. 1.

As shown in FIGS. 1, 2, in the chained-terminals body 1, each of a plurality of first terminals T1 and a plurality of second terminals T2 to be connected to each conductor 21 of a flat circuit body 2 is arranged alternately in parallel to each other at even intervals. The chained-terminals body 1 has a pair of a first chained-terminals sub-body 1*a* and a second chained-terminals body 1*b*. The flat circuit body 2 has a plurality of conductors 21 arranged in parallel to each other at intervals and a insulating cover 22 covering the conductors 21, and is formed into a flat-belt shaped electric wire. At an end of the flat circuit body 2, the conductors 21 is exposed by removing the cover 22.

The first chained-terminals sub-body 1*a* is formed by punching and bending a conductive sheet metal, and has a first connecting band 10*a* formed into band shape and a plurality of first terminals T1. The first connecting band 10*a* has feed holes 11 penetrating through the connecting band 10*a*. The feed holes 11 are engaged with feed pins of a terminal feed unit (not shown) when the chained-terminals body 1 is fed from a terminal supply unit toward a terminal-crimping unit.

The first terminal T1 has an electric contact portion 12 to be connected with a mating terminal and an electric wire connecting portion 13 to be connected with the flat circuit body 2. The electric contact portion 12 includes a rectangular sleeve and a spring piece (not shown) received in the rectangular sleeve. The spring piece pushes a contact element of a mating terminal, which is inserted into the rectangular sleeve, toward an inner surface of the rectangular sleeve for clamping the contact element between the spring piece and the inner surface of the rectangular sleeve. Thereby, the electric contact portion 12 is connected electrically and mechanically to the mating terminal.

The electric wire connecting portion 13 includes a first bottom wall 14*a* continuous to an outer wall of the rectangular sleeve, a pair of conductor crimp pieces 15, and a pair of cover clamp pieces 16.

The end of the flat circuit body 2 is placed on a surface of the first bottom wall 14*a*. In other words, a conductor 21 exposed at the end of the flat circuit body 2 is placed on the first bottom wall 14*a*.

The pair of conductor crimp pieces 15 projects from both side edges in a direction of width of the bottom wall 14 at the center in a direction of length of the bottom wall 14. Front ends of the conductor crimp pieces 15 are bent to near toward the bottom wall 14, so that the conductor 21 of the flat circuit body 2 is crimped between the conductor crimp pieces 15 and the bottom wall 14. Thus, the conductor crimp pieces 15 is crimped with the conductor 21 of the flat circuit body 2.

The pair of first cover clamp pieces 16*a* is provided at an end of a far side from the electric contact portion 12 in the direction of length of the first bottom wall 14*a*. The first cover clamp pieces 16*a* project from both edges in the direction of width of the first bottom wall 14*a*. Front ends of the first cover clamp pieces 16*a* are expanded with a wide angle so as to project toward outside of the first terminal T1. The first cover clamp pieces 16*a* penetrate the cover 22 of the flat circuit body 2. The front ends of the first cover clamp pieces 16*a* are bent to near toward the first bottom wall 14*a*, so that the cover 22 is clamped between the first bottom wall 14*a* and the first cover clamp pieces 16*a*. Thus, the first cover clamp pieces 16*a* are clamped with the cover 22 of the flat circuit body 2.

In the first chained-terminals sub-body 1*a*, the plurality of first terminals T1 is arranged in parallel to each other at even intervals, and continued to the first connecting band 10*a*. An end at a far side from the electric contact portion 12 of the first terminal T1 is continued to the first connecting band 10*a*. An interval between adjacent first terminals T1 is wider than the width of the first terminal T1. Distances from the first connecting band 10*a* to the first cover clamp pieces 16*a* of all first terminals T1 are equalized.

The second chained-terminals sub-body 1*b* is formed by punching and bending a conductive sheet metal, and has a second connecting band 10*b* formed into band shape and a plurality of second terminals T2, similarly as the first chained-terminals sub-body 1*a*. The same components as the first chained-terminals sub-body 1*a* are given with the same mark and description about them is omitted.

A distance from the conductor crimp pieces 15 to the second cover clamp pieces 16*b* of the second terminal T2 is formed shorter than a distance from the conductor crimp pieces 15 to the first cover clamp pieces 16*a* of the first terminal T1. In the second chained-terminals sub-body 1*b*, the plurality of second terminals T2 is arranged in parallel to each other at even intervals, and continued to the second connecting band 10*b*. An end at a far side from the electric contact portion 12 of the second terminal T2 is continued to the second connecting band 10*b*. An interval between the adjacent second terminals T2 is formed to equal the interval between the adjacent first terminals T1 of the first chained-terminals sub-body 1*a*. Distances from the second connecting band 10*b* to the second cover clamp pieces 16*b* of all second terminals T2 are equalized and formed longer than the distances from the first connecting band 10*a* to the first cover clamp pieces 16*a* of the first terminals T1.

As shown in FIG. 3, the chained-terminals body 1 is formed by manufacturing respectively the first chained-terminals sub-body 1*a* and the second chained-terminals sub-body 1*b*, and piling them together so as to arrange each second terminal T2 of the second chained-terminals sub-body 1*b* between the adjacent first terminals T1 of the first chained-terminals sub-body 1*a*. In this embodiment, the feed holes 11 can also perform to position the first and second chained-terminals bodies 1*a*, 1*b*. By piling the pair of the first/second chained-terminals bodies 1*a*, 1*b* so as to align each feed holes 11 thereof, an interval between the first and second terminals T1, T2 adjacent to each other, that is a terminal pitch, is equalized. Thereby, the first/second terminals T1, T2 are arranged at even intervals. The terminal pitch of the chained-terminals body 1 corresponds to a conductor pitch of the flat circuit body 2.

According to the chained-terminals body 1 formed as mentioned above, the distance from the first connecting band 10*a* to the first cover clamp piece 16*a* of the first terminal T1 of the first chained-terminals sub-body 1*a* is shorter than the distance from the second connecting band 10*b* to the second cover clamp piece 16*b* of the second terminal T2 of the second chained-terminals sub-body 1*b*. A distance from the first conductor crimp piece 15*a* to the first cover clamp piece 16*a* of the first terminal T1 is longer than a distance from the second conductor crimp piece 15*b* to the second cover clamp piece 16*b* of the second terminal T2. Thereby, the first/second cover clamp pieces 16*a*, 16*b* of the first/second terminals T1, T2 are arranged alternately, and the first cover clamp pieces 16*a* are arranged on a line in a direction of width of the first terminal and the second cover clamp pieces 16*b* are arranged on another line in a direction of width of the second terminals. Thus, adjacent cover clamp pieces 16*a*, 16*b* are arranged alternately to each other. Therefore, a distance between each cover clamp pieces 16*a*, 16*b* and each terminal T1, T2 can become larger.

Each terminal T1, T2 of the aforesaid chained-terminals body 1 is crimped with each conductor 21 of the flat circuit body 2 by the crimping device partially shown in FIG. 1. The connecting bands 10*a*, 10*b* are cut off from each terminal T1, T2 by a cutting blade (not shown) simultaneously when the terminals T1, T2 are crimped.

The aforesaid crimping device includes a main body (not shown), an anvil 4 and crimper 3. The main body is installed on a floor of a facility. The anvil 4 is fixed on the main body, and the chained-terminals body 1 is placed on a mount surface 41 thereof. The crimper 3 faces the anvil 4 with a space, and is supported by the main body so as to move freely close-to/apart-from the anvil 4. In other words, the crimper 3 and the anvil 4 are provided to move freely close-to/apart-from each other. In the crimping device, the chained-terminals body 1 and the end of the flat circuit body 4 are placed on the anvil 4 when the anvil 4 and the crimper 3 are positioned apart from each other. The anvil 4 and the crimper 3 move close to each other and clamp the chained-terminals body 1 and the flat circuit body 2 therebetween. Thereby, the first/second crimp pieces 15*a*, 15*b*, and the first/second clamp pieces 16*a*, 16*b* are deformed. In FIG. 1, the later-described anvil 4 and the crimper 3 are shown.

The crimper 3 has a plurality of grooves 31, 32 corresponding to the mount surfaces 41 of the anvils 4. The grooves 31, 32 are located corresponding to positions of the plurality of the first/second cover clamp pieces 16*a*, 16*b* of the chained-terminals body 1 to be mounted on the mount surface 41. In other words, the grooves 31, 32 adjacent along a direction of width of the first/second terminals T1, T2 are shifted to each other along a direction of length of the terminals T1, T2. The grooves 31 provided at one interval and the grooves 32 provided at one interval are aligned respectively on each line along the direction of width of the terminals T1, T2. Thereby, partitioning walls 33, 34 between the grooves 31, 32 aligned in each line can secure enough strength thereof.

As shown in FIG. 4, the first cover clamp pieces 16*a* of the first terminal T1 is positioned in the groove 32 located at a far side in FIG. 4. The second cover clamp pieces 16*b* of the second terminal T2 is positioned in the groove 31 located at a near side in FIG. 4.

Assuming that the cover clamp pieces 16*a*, 16*b* of the first/second terminals T1, T2 are aligned on one line, the partitioning walls 33, 34 are eliminated. Thereby, the crimper 3 for clamping the first/second cover clamp pieces 16*a*, 16*b* cannot be realized. According to the embodiment, the cover clamp pieces 16*a*, 16*b* and the grooves 31, 32 are arranged alternately, so that the crimper 3 can be realized even if the terminal pitch of the chained-terminals body 1 would become shorter.

The terminals T1, T2 of the aforesaid chained-terminals body 1 are connected to the flat circuit body 2 as following. The chained-terminals body 1 is supplied from a terminal supply unit, and cut to have required numbers of T1, T2. The cut chained-terminals body 1 is engaged at the feed hole 11 with a pin (not shown) of the feed unit to be fed to the crimp device. The chained-terminals body 1 fed to crimp device is placed on the anvil 4 to pile the bottom wall 14*a*, 14*b* on the mount surface 41. The flat circuit body 2 is fed to the crimp device by a feed unit (not shown), and piled on the chained-terminals body 1 to make the conductors 21 corresponding to the terminals T1, T2. By moving the crimper 3 and the anvil 4 closer to each other, the terminals T1, T2 are crimped to each conductor 21 of the flat circuit body 2. Simultaneously, the connecting bands 10*a*, 10*b* continued to the terminals T1, T2 are cut off by the cutting blade (not shown). A flat circuit body assembly 50, in which the terminals T1, T2 are crimped to each conductor 21 of the flat circuit body 2, shown in FIG. 5, is assembled to a wiring harness by inserting the terminals T1, T2 into a connector housing (not shown).

In the embodiment, the electric contact portion of the terminal T1, T2 is a female contact with a rectangular sleeve shape. According to the present invention, the terminal T1, T2 can be a male contact with a pin shape.

In the embodiment, the electric wire is the flat circuit body 2 with the plurality of conductors 21 arranged in parallel. According to the present invention, the electric wire can be a round wire having a conductive core wire. In the case, a plurality of round wires can be crimped in one process.

While, in the embodiment, the present invention is described, it is not limited thereto, and various change and modifications can be made with the scope of the present invention.

What is claimed is:

1. A chained-terminals body comprising:

first and second terminals respectively having a bottom wall to place an electric wire thereon and a pair of cover clamping pieces extending on a line in a width direction of the terminal, and perpendicularly from the bottom wall, and a pair of conductor crimp pieces spaced from said pair of cover clamping pieces, each of said pair of conductor crimp pieces projecting from a side edge in a direction of the width of said bottom wall; and a connecting band continued to the terminals to be arranged in parallel to each other at even intervals, wherein pairs of the cover clamping pieces of the adjacent terminals are arranged alternately to each other in a lengthwise direction of the terminal and a distance from the conductor crimp pieces to the cover clamping pieces of the terminal is larger than a distance from the conductor crimp pieces to the cover clamping pieces of the second terminal.

2. The chained-terminals body according to claim 1, wherein the electric wires are formed by a flat circuit body, in which a plurality of conductors arranged in parallel to be spaced wit each other is covered wit a cover, and a conductor pitch of the plurality of conductors of the flat circuit body corresponds to a terminal pitch of the chained-terminals body.

3. A chained-terminals body comprising:

a first chained-terminals sub-body including:

first terminals respectively having a first bottom wall to place an electric wire thereon and a pair of first cover clamping pieces extending on a line in a width direction of the terminal, and perpendicularly at a first position from the first bottom wall; and a first connecting band continued to the first terminals to be arranged in parallel to each other at even intervals; and a second chained-terminals sub-body including:

second terminals respectively having a second bottom wall to place an electric wire thereon and a pair of second cover clamping piece5 extending on a line in a width direction of the terminal, and perpendicularly at a second position other than the first position from the second bottom wall; and a second connecting band continued to the second terminals to be arranged in parallel to each other at the same even intervals as that of the first chained-terminals sub-body, wherein the first chained-terminals sub-body and the second chained-terminals sub-body are assembled by piling on each other so as to position each of the first terminals between the second terminals adjacent to each other to arrange all terminals at half of even intervals and arrange pairs of first/second cover clamping pieces of the adjacent terminals alternately to each other in a lengthwise direction of the first/second terminal.

4. The chained-terminals body according to claim 3, wherein the electric wires are formed by a flat circuit body, in which a plurality of conductors arranged in parallel to be spaced with each other is covered with a cover, and a conductor pitch of the plurality of conductors of the flat circuit body corresponds to a terminal pitch of the chained-terminals body.

* * * * *